United States Patent [19]

Brummett et al.

[11] 4,006,047

[45] * Feb. 1, 1977

[54] CATALYSTS FOR ELECTROLESS DEPOSITION OF METALS ON COMPARATIVELY LOW-TEMPERATURE POLYOLEFIN AND POLYESTER SUBSTRATES

[75] Inventors: Charles Roscoe Brummett, Harrisburg; Ray Ned Shaak, Lebanon; Daniel Marshall Andrews, Harrisburg, all of Pa.

[73] Assignee: AMP Incorporated, Harrisburg, Pa.

[ * ] Notice: The portion of the term of this patent subsequent to Feb. 10, 1993, has been disclaimed.

[22] Filed: Nov. 8, 1974

[21] Appl. No.: 521,999

Related U.S. Application Data

[63] Continuation-in-part of Ser. No. 490,817, July 22, 1974, Pat. No. 3,937,857.

[52] U.S. Cl. ..... 156/656; 156/659; 427/98; 427/226; 427/229; 427/259; 427/261; 427/265; 427/304; 427/305; 427/306; 427/307; 106/1

[51] Int. Cl.[2] ..... B05D 5/12; B05D 3/04

[58] Field of Search ..... 117/212, 47 R, 47 A; 427/304, 305, 306, 307, 96, 98, 259, 226, 261, 229, 265, 282; 106/1; 156/3, 7, 8, 18

[56] References Cited

UNITED STATES PATENTS

| | | | |
|---|---|---|---|
| 3,212,918 | 10/1965 | Tsu et al. | 117/47 A |
| 3,370,973 | 2/1968 | Romankin | 117/71 R |
| 3,414,427 | 12/1968 | Levy | 427/306 |
| 3,457,638 | 7/1969 | Johnson | 117/212 |
| 3,544,432 | 12/1970 | Ishii et al. | 117/47 A |
| 3,558,443 | 1/1971 | Khelghatian et al. | 117/47 A |
| 3,562,118 | 2/1971 | Baier et al. | 117/47 A |
| 3,666,549 | 5/1972 | Rhodenizer et al. | 117/47 A |
| 3,674,550 | 7/1972 | Mallory | 117/212 |
| 3,684,534 | 8/1972 | Emerson | 117/47 A |
| 3,698,940 | 10/1972 | Mersereau et al. | 117/212 |
| 3,704,156 | 11/1972 | Foley, Jr. et al. | 117/47 R |
| 3,741,800 | 6/1973 | Baier et al. | 117/47 A |
| 3,745,095 | 7/1973 | Chadwick et al. | 117/47 A |
| 3,799,816 | 3/1974 | Schneble, Jr. et al. | 117/47 A |
| 3,808,028 | 4/1974 | Lando | 117/47 A |
| 3,937,857 | 2/1976 | Brummett et al. | 427/306 |

*Primary Examiner*—Michael F. Esposito
*Attorney, Agent, or Firm*—Russell J. Egan

[57] ABSTRACT

A method for the metallization of a nonconductive surface with gold, nickel or copper whereby on a nonconductive, relatively low temperature surface (such as a polyester or a polyolefin) a thermosensitive coordination complex of palladium (or platinum) is deposited from a solvent; the complex has the general formula LmPdXn wherein L is a ligand or unsaturated organic radical, X is a halide, alkyl group or a bidentate ligand and m is an integer from 1 to 4 and n is from 0 to 3; bis-benzonitrile palladium dichloride complex is an appropriate illustration; the palladium complex is applied in a thin film from a suitable nonaqueous solution solvent such as xylene, toluene or a chlorobenzene onto the surface of the nonconductive material and that thin film is thermally decomposed, such as by an infrared irradiation; the method in the preferred embodiment can be practiced without the necessity of surface etching or similar chemical conditioning of the polyester, polyamide, polyvinyl chloride, or polyolefin substrate prior to the catalytic coating; circuit element intermediates of said substrates are also disclosed.

15 Claims, 1 Drawing Figure

Figure 1:
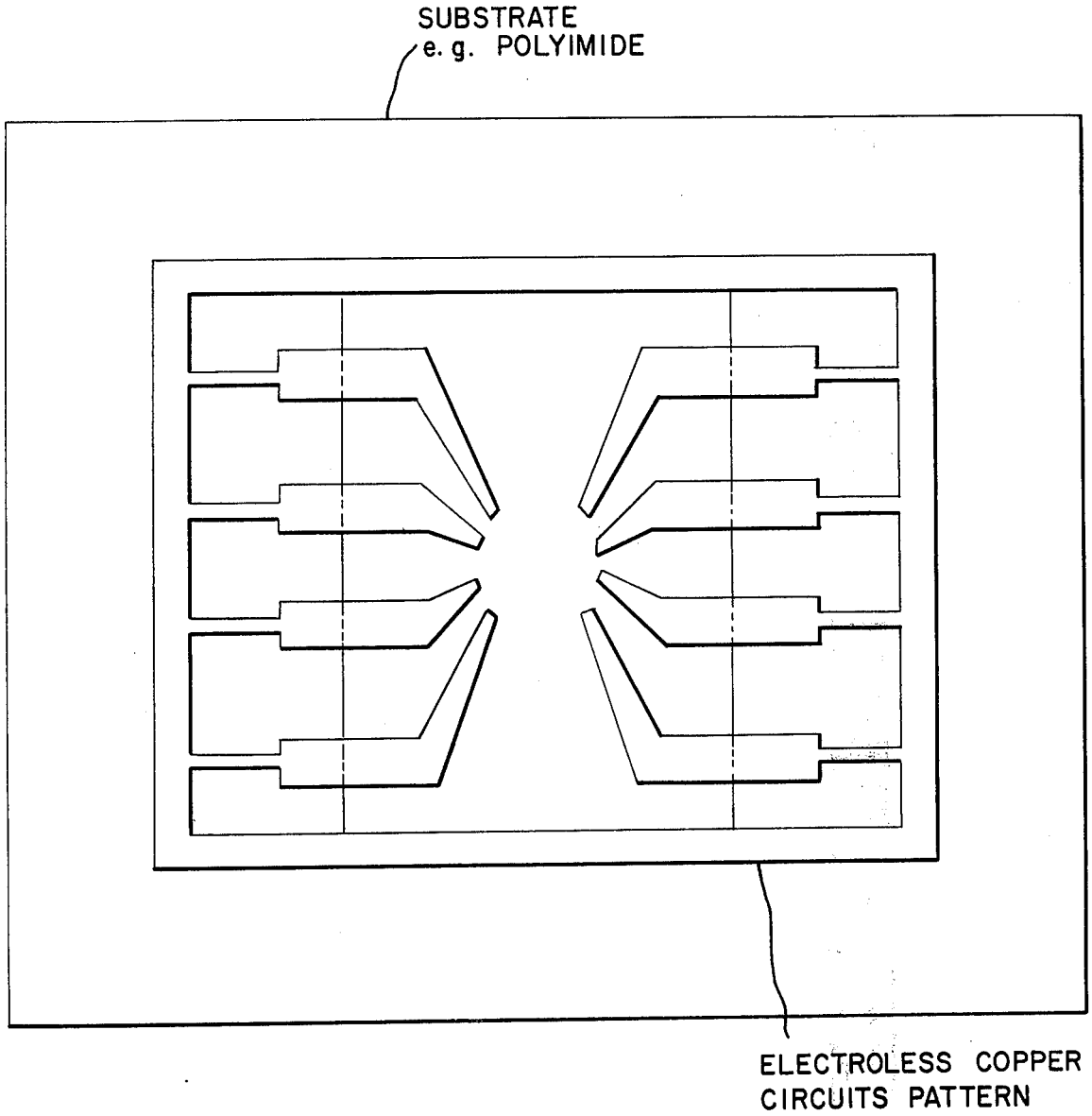

CATALYSTS FOR ELECTROLESS DEPOSITION OF METALS ON COMPARATIVELY LOW-TEMPERATURE POLYOLEFIN AND POLYESTER SUBSTRATES

This application is a continuation-in-part of copending application Ser. No. 490,817 filed July 22, 1974 now Patent No. 3,937,857.

This invention relates broadly to a process for metallizing non-conductive surfaces by depositing metals from electroless metal plating baths. More specifically, this invention relates to a thermal decomposition, on a nonconductive substrate, of a desired layer of a thermal decomposition product which is catalytic to gold, nickel, cobalt or copper in an electroless bath for deposition of these metals on the substrate. More particularly, this invention relates to a process for manufacturing flat-flexible or additive and semi-additive circuitry by thermally decomposing a composition deposited as a continuous or discrete thin film on a low heat resistant substrate such as polyolefin or polyester. A coordination complex of palladium or metal compound applied to a non-conductive substrate and thereafter decomposed will deposit thereon electroless metal from a bath on the residue of the film in a pattern or as a continuous film. The residue of the complex renders catalytic the deposited area to the metal ion in the electroless bath. This decomposition permits, by additive electroless process or semi-additive process the subsequent formation of circuit patterns of intricate design and desirable resolution. With respect to the semi-additive process, the resist and back etch operation is with respect to the electroless deposit only. However, the substractive process (whereby an electrolytic deposit is made and then the same is appropriately backetched) is also possible when practicing the present method.

Printed circuits and flat flex circuitry have been used in numerous electrical and electronic applications in many industries. A number of methods for producing selected metallic patterns on a variety of nonconductive surfaces are known and these processes include electroplating, electroless plating as well as various printing processes, and etching processes.

It has been recognized that satisfactory products and good economy are achieved when using electroless plating techniques to deposit the metal upon selected areas of the nonconductive surface. In general, electroless plating requires a sensitization of the substrate in the areas upon which metal is to be deposited from electroless solution. This sensitization is achieved by providing a pattern of a salt of precious metal on the substrate in the areas where it is desired to reduce the electroless metal from the solution thereof.

The emplacement of the salts which are catalytic to the reduction of electroless metal may be accomplished by the well-known techniques of complete coverage of the substrate or masking the substrate or selectively applying the catalytic materials as by silk screening or by the use of photographic techniques. These techniques and the techniques for depositing the thin film of metal from an electroless solution are disclosed in numerous patents, among them U. S. Pat. Nos. 3,259,559; 3,562,005, and 3,377,174.

Several problems have been associated with prior art processes. It is most important to ensure that there is satisfactory adhesion between the precious metal catalytic deposit and the subsequently deposited electroless metal. If the adhesion is insufficient, the circuits fail such as when subjected to mechanical handling or heat shock and the conductive layer may become separated from the substrate. Other techniques for depositing on flexible substrates have produced copper, nickel, or gold deposits which are brittle and which upon bending exhibit unsatisfactory ductility in service.

Moreover, there are a number of disadvantages inherent in prior art techniques for producing the metallized pattern on the nonconductive surfaces. For example, in masking techniques, the problems of registration of the mask and poor edge definition of the metallic pattern are serious and the inefficiencies and expenses associated with wasting the mask where it comprises a photo resist are self-evident. Other problems associated with masking are that various solvents must be used, some of which may have a deleterious effect on the catalysts. Where photographic techniques are used, the process is more difficult to carry out because the photographic emulsions must be protected from ambient light conditions to prevent nonselective fixing of the catalytic material. The number of processing steps required for development is relatively large with attendant cost and inefficiency and the final product has often been found to have an unacceptable surface roughness.

As was disclosed in the aforementioned parent application Ser. No. 490,817, filed July 22, 1974 now U.S. Pat. No. 3,937,857, it has been now found that contrary to prior art experience, in processes wherein the catalyst is emplaced on the desired substrate and heating steps are involved to drive off the volatile liquid components from the complex and the carrier solvent for the complex, the employment of the desired complex such as of the formula $(C_6H_5C \equiv N)_2\ PdCl_2$, in combination with the proper solvent, has little damaging effect upon the substrate. It has been found that an electroless coating upon the so-prepared substrate has an acceptable surface smoothness and especially adhesion.

It has also been found that not only polyimide substrates disclosed in the companion application are suitable for thermal decomposition of the complex and obtainment of catalyzed surfaces for acceptance of a metal from an electroless bath, but also that the surfaces of other inert substrates can be made receptive to the metal in an electroless bath, if the complexes disclosed in the companion application are used with an appropriate solvent for decomposition of a suitable decomposition temperature for substrates having lower temperature stability.

It has now been further discovered that a process, wherein the catalyst is emplaced in the desired pattern on a polyester, polyamide, polyvinyl chloride, or polyolefin substrate by the low-temperature heating steps, provides the necessary adhesion between an electroless metal and the substrate. Inasmuch as the heat normally used can have a damaging effect upon such a substrate, the catalysts decompose at low temperatures, i. e., at temperatures which do not affect polyolefins provide the benefits of low temperature operation without the shortcomings such as an unacceptable surface roughness or pinholes often encountered with prior art process. Complexes which decompose at higher temperatures provide catalytic surfaces on the more heat resistant substrates. In general, a decomposition temperature range for a complex from 85° C to 155° C is suitable for polyesters and polyamides. The lower part of the range, i. e., below 100° C is suitable for the other substrates.

It is therefore the primary object of this invention to provide an improved method for depositing electroless metal upon temperature sensitive, nonconductive substrates.

It is a further and related object of this invention to provide such a process which is efficient to use and which achieves the production of a strong and adherent conductor pattern on a variety of inexpensive low temperature insulating materials.

It is a further related object of this invention to provide a process which produces printed circuits and flat flexible circuitry which is durable and inexpensive.

It is a further and more specific object of this invention to provide a technique for low-temperature depositing upon a nonconductive polyolefin, polyvinyl chloride, polyamide, or polyester or equivalent substrate a material which is catalytic to the subsequent reduction of electroless nickel, copper, cobalt, or gold from a bath thereof and to achieve this low-temperature catalyzation of the nonconductive surface by a low-temperature thermal decomposition technique which is simple and efficient to use and provides new circuit element intermediates for forming circuit elements by electroless addition or resist and back-etch technology.

It is a further object of some preferred embodiments of this invention to provide a catalytic coating on such substrate without surface etching or similar chemical conditioning of the substrate surface prior to applying said coating (and contrary to prior art practice) and still achieve a superior product after subsequent metallization.

It is a further and related object of this invention to provide a low-temperature decomposable complex of a metal salt which is catalytic to reduction of electroless metal whereby said decomposable complex is a member of a class suitable for an olefin substrate or a member of a class suitable for both olefin and polyester substrate.

These and other objects of this invention are achieved in a method for the general electroless deposition of metals upon a non-conductive substrate, e. g., on a polyolefin or polyester film, wherein a thin film of a thermosensitive coordination complex of palladium is first applied to the substrate.

As an illustration of a suitable circuit, FIG. 1 shows a lead frame produced when practicing the present invention.

The coordination complex of palladium has the formula:

$$L_mPdX_n$$

wherein L is a ligand or unsaturated organic group; Pd is the palladium metal base of the complex; X is a halide, alkyl group, or bidentate ligand; and $m$ and $n$ are integers, i. e., $m$ is from 1 to 4 and n is from 0 to 3. With respect to the complex suitable for an olefin, the thermal decomposition temperature of the above must be about the maximum continuous service temperature defined for each olefin, e. g., polyethylene or the other poly $\alpha$-olefins and olefin copolymers of poly $\alpha$-olefins, the upper maximum limit is the softening temperature of the polymer or non-heat distortion temperature. A suitable margin of safety is easily developed for each polymer and complex, i. e., the decomposition temperature of the complex should not affect the functional properties of the substrate such as dimensional stability. Hence, as a safe rule, the decomposition temperature of the complex must be below the softening temperature of the polymer but can be above the maximum continuous service temperature of the polymer.

With respect to the polyesters, the same criterion applies, generally the maximum continuous service temperature is the benchmark, and the softening temperature, the upper limit, with a margin of safety, e. g., about 30° to 40° C below the softening point of the polymer.

In the complex above, L is: a phosphine moiety or a phosphite moiety, each is substituted with substituents such as aromatic mononuclear (e. g., phenyl) or polynuclear (e. g., napthyl) or an alkyl group or mixed alkyl groups of 1 to 10 carbon atoms in the alkyl group; a nitrile such as an aromatic nitrile, e. g., benzonitrile, or an aliphatic nitrite, e. g., acetonitrile generally having up to 8 carbon atoms in said nitrile moiety; a diene such as an aliphatic diene from 4 to 8 carbon atoms, e. g., 1,3-butadiene or an alicyclic diene, e. g., a cyclooctandiene; or an amine, e. g., alkylene di- or tetraamine of 2 to 4 carbon atoms in the alkylene portion thereof such as triethylene tetramine, ethylene diamine; triethanol amine, diethanol alkylamine of 1 to 4 carbons in the alkyl group, etc.

Platinum complexes of the above will also be suitable except from cost standpoint. Nickel and copper complexes were tried, but thermal decomposition yielded only metal oxides which were not catalytic.

In the aforementioned copending parent application in addition to the broad disclosure, particular emphasis was given to the high-temperature substrates such as polyimides which metallization by the disclosed invention could usefully give flexible circuitry capable of withstanding solder dip temperatures of 210 to 220° C. However, not all flexible circuitry requirements are as stringent as those for which polyimide substrates are used, and other termination systems than soldering can be used. In many cases temperature and strength requirement are sufficiently low that the use of inexpensive, low temperature polymer materials can result in substantial cost savings. For example, low cost temperature sensitive substrates such as polyesters, e. g., Mylar, polyamides, e. g., Nylon 66, and polyolefins, e. g., polyethylene, polyethylene, polypropylene and their copolymers, can be catalyzed so that dissolved nickel, copper, cobalt, and gold will nucleate and deposit on the surface of the polymer in an electroless plating bath.

Polyester, polyamide, polyvinyl chloride, or polyolefin surfaces can be coated with a thin, evenly dispersed layer of palladium residue which is catalytic to electroless nickel and copper deposition without the necessity of surface etching or chemical contitioning other than degreasing prior to coating, giving a further simplicity and resultant cost saving.

In a preferred embodiment, a tape of polyester substrate such as Mylar, is steadily withdrawn from a tetrahydrafuran solution of bis-benzonitrile palladium dichloride. The volatile solvent flashes off as the strip is withdrawn leaving a thin, evenly dispersed film of the complex. When the treated tape is heated to 90° C by exposing the surface to an infrared lamp, the complex is thermally decomposed leaving a dark brown residue. A polyester tape treated in this matter is particularly catalytic to electroless nickel or copper deposition producing an adherent metallization of the polymer surface. Similar success is achieved using other nitrile complexes, such as bis-acetonitrile palladium dichloride, and diene substituted complexes, such as 1,3-butadiene palladium dichloride; but the bis-benzonitrile palladium dichloride complex is preferred because of simplicity of synthesis and quality of metallization product. This procedure is used to metallize polymers in a continuous strip operation.

Polyethylene, polypropylene and polyolefin copolymers can be similarly metallized using bis-benzonitrile palladium dichloride or its equivalent as the catalyst source because the decomposition temperature of this catalyst is about 85° C. A specific solvent system is needed for these either crosslinked or uncrosslinked polymers, since tetrahydrafuran does not wet polyolefins easily. Aromatic hydrocarbons such as xylene, toluene, and chlorobenzene were found to swell uncrosslinked polyolefins slightly at temperatures of 30° C. For crosslinked polyolefins the temperature must be raised to 50° C to accomplish the same degree of solvent swelling. Under the conditions described, these solvents will flash off leaving an evenly dispersed film of complex which is then pyrolized and metallized by the procedure described for polyesters.

A group of organo-nitrile and diene substituted palladium compounds having low decomposition temperatures and therefore being useful for catalyzation of polyesters and polyolefins are synthesized as follows:

Palladium dichloride is suspended in a nitrile compound, such as benzonitrile of acetonitrile, and the mixture warmed until the palladium halide is completely dissolved. The solution is filtered while it is still warm and the filtrate is poured into low boiling petroleum ether or n-hexane. Crystals which fall out are removed by filtration. If a diene substituent is desired, diene gas such as 1,3-butadiene is bubbled through a benzene solution of the bis-benzonitrile palladium dichloride. Diene groups will displace the benzonitrile groups. The complexes are recovered by simple precipitation and filtration procedures in high yields. Most organo-nitrile or diene palladium halide coordination complexes are stable in air and can be stored on the shelf. These compounds are soluble in a variety of organic solvents, but tend to decompose slowly if kept in solution for more than a few days. This decomposition can be virtually eliminated by cold storage. The thermal decomposition temperature of these types of compounds is generally below 100° C. It is this property which accounts for their attractive industrial application in surface catalyzation of a number of low temperature melting polymers.

The non-conductive substrates upon which the palladium coordination complexes are applied may be selected from a broad grouping of polyester substrate materials which have found use in electrical circuit applications. Among these are polyester films such as "Mylar" manufactured by DuPont Company, "Valox" manufactured by AMP, Inc., and polyesters described in available trade and patent literature.

As polyolefins, suitable examples are polyethylene sold under various trademarks, polypropylene, copolymers of polyethylene and copolymers of polypropylene and poly ($\alpha$-olefins) in the near homologous series of the polyethylene and polypropylene.

Generally, the substrate is of a thickness used in printing circuit technology, e. g., 0.5 to 5.0 mils, preferably 2 to 3 mils; thicker substrates may also be used.

The coordination complex of palladium is applied to the substrate, which has preferably been degreased by passing it through a degreasing solvent such as a fluorinated hydrocarbon, e. g., Freon or a chlorinated hydrocarbon such as 1,1,1-trichloro ethane, trichloro ethylene, carbon tetrachloride, etc., by dipping the material in a solution of the complex and removing excess solution.

It has been found that using the processes of this invention, printed circuitry can be efficiently manufactured in an electroless semi-additive process by photoresist masking and electrolytically building up the circuit elements. After coating the additive circuitry with a protective covering such as gold, or tin-lead alloy, the photoresist is then stripped and the base metal between the circuitry regions is etched away chemically. In the event the circuitry thickness requirements are not so great requiring the preceding process, the photomask and chemical etch steps can be eliminated by selective catalytic placement, decomposition, and metallization only on the circuitry regions. The printed circuitry manufactured has satisfactory mechanical and electrical characteristics such as established by Scotch tape test which is well known in the electronic circuitry arts.

The polymers disclosed and their equivalents may be in sheet, film slab, or of a desired shape, etc., and may be filled to make rigid or impart other desired properties, when necessary. Thus, although the polyesters and polyolefins disclosed are typically low-temperature polymers, modified forms do also exist giving polymers of higher temperature characteristics and, of course, different species exist within the given designation. For example, Mylar is polyethylene terephthalate which has a reported maximum continuous service temperature of 121° C (even though the softening point for Mylar film is 250–255° C). The polyester poly (1,4 cyclohexylene-dimethylene terephthalate) has a reported maximum continuous service temperature of 149–182° C. Maximum continuous service temperatures are 93° C and 121° C for types I, II, and III polyethylene and 149° C for polypropylene.

The other substrates mentioned herein such as the polyamides, e. g., Nylon 66, have higher melting points than the polyolefins. Thus, Nylon 66 has a melting point of 264° C. Hence, the appropriate complex can readily be selected based on the decomposition temperatures of the complex and the dimensional stability of the polyamide or polyvinyl dichloride substrate. These polymers are well known in the patent literature and need not be described herein.

Representative complexes are:

Bis-triphenylphosphine palladium dichloride, bis-triphenylphosphine dimethyl palladium, bis(triphenylphosphine) di(secondarybutyl) palladium, bis-triphenyl-phosphine palladium oxalate, bis-triphenylphosphine palladium diamine, tris-trphenylphosphine palladium chloride, tetrakistriphenylphosphine palladium (0); bis-triethyl phosphine and bis-tri-n-butyl phosphine palladium chloride or the dialkyl e. g. dimethyl, dibutyl, etc., oxalate, and borohydride substituents of the complex, bis-trimethylphosphite palladium dichloride or the dialkyl e. g. dimethyl, disec.butyl, etc., oxalate, succinate, citrate, and borohydride substitutions, bis-benzonitrile and bis-acetonitrile palladium dichloride, 1,3-butadiene palladium dichloride, and bis-triethylene tetramine palladium dichloride and bis-triethylene tetramine palladium oxalate. With respect to alkyl moieties, described above, these are generally from 1 to 6 carbon atoms, preferably from 1 to 4 carbon atoms. The above complexes must be selected, however, as outlined above with reference to the dimensional stability of the substrate at the decomposition temperature.

Synthesis of the above-mentioned bis-trimethylphosphite palladium dichloride and related compounds will now be described:

Palladium-phosphorous coordination complexes are synthesized specifically by slowly adding organo-phosphine or organo-phosphite compounds to an organic solvent slurry of palladium dichloride at reduced temperature. These complexes may be purified by freezing the pure crystals from a saturated solution of a suitable solvent. Bis-trimethylphosphite palladium dichloride, for example, is produced by slowly adding trimethylphosphite to an acetone slurry of palladium dichloride at ice water temperature. Crystals may be purified in tetrahydrafuran by freezing the saturated solution. The alkyl substituted compounds are made by adding lithium alkyl to the desired organo-phosphorus metal chloride complex in an ether solution. Chloride moieties are replaced with the corresponding alkyl group or groups. Oxalate or borohydride substitutions are made by adding sodium oxalate or sodium borohydride to an ether solution of the desired chloride complex. Tetrakis, zero valent (0), complexes are synthesized by adding an additional quantity of organo-phosphorus compound to an organo solution of the bis-organo phosphorus metal dichloride, and then adding a strong reducing agent such as hydrazine. The chloride moiety is displaced leaving a metal atom with four organo-phosphorus ligands coordinated with a net zero valence.

In general, the palladium complex materials can be synthesized by simple precipitation and filtration, or solvent evaporation procedures, and stored as crystals or in solutions until needed for specific product applications. Such applications may include besides the previously described surface catalyzation of non-conductive materials, as previously described, electroless and nonaqueous immersion plating of palladium, electrolytic deposition of palladium, electrolytic deposition of palladium and chemical vapor deposition of palladium on a heated substrate. Before a successful deposit can be made, the substrate must be prepared in an appropriate matter.

Illustrative moieities of the above complexes are set forth below; preparation of these show the numerous complexes which may be synthesized:

1. Bis-triphenylphosphine palladium dichloride $[(C_6H_5)_3P]_2PdCl_2$ decomposition temperature 295° C. Dissolve 2 moles, plus 5% excess, of triphenylphosphine in acetone. Dissolve 1 mole of palladium dichloride in water with a slight excess of chloride ion either from HCl to KCl. Slowly pour phosphine solution into palladium solution with stirring till lemon yellow precipitate complete (10 min.). Filter crystals and wash first with water then with acetone. Dried crystals represent 94% of theoretical yeild.

2. Tetra-kis-triphenylphosphine palladium zero valent $[(C_6H_5)_3P]_4Pd°$ decomp. temp. 98° C. Slurry 1 mole of bis-triphenylphosphine palladium dichloride and 2 moles, plus 5% excess, of triphenylphosphine in ethanol under nitrogen. Add 2½ moles of hydrazine in ethanol dropwise to the stirring solution. Stir for ½ hour. Filter, wash with ethanol, dry in vacuum.

3. Bis-triphenylphosphine palladium dimethyl$[(C_6H_5)_3P]_2Pd(CH_3)_2$ decomp. temp. 275° C. Place 1 mole of bis-triphenylphosphine palladium dichloride in an ether slurry. Add 2 moles of methyl lithium, plus a 15% excess, in ether solution and allow to stir for 1 hour to insure complete alkyl displacement of chloride ligands. Filter, wash with water and then with ether to remove all lithium chloride and unused lithium alkyl. Dry in air.

4. Bis-tri-n-butylphosphine palladium dichloride$[(C_4H_9)_3P]_2PdCl_2$ decomp. temp. 155° C. Dissolve 2 moles, plus a 5% excess, of tri-n-butyl phosphine in methanol. Slurry 1 mole of anhydrous palladium dichloride in acetone. Slowly pour the phosphine solution into the palladium slurry with strirring. Crystals are obtained by evaporating solvents. Avoid contact with water; this complex forms unstable hydrates.

5. Bis-tri-n-butyl phosphine palladium dimethyl$[(C_4H_9)_3P]_2Pd(CH_3)_2$ decomp. temp. 145° C. Dissolve 1 mole of bis-tri-n-butylphosphine palladium dichloride in ether. Add 2 moles, plus 5% excess, of methyl lithium slowly and allow to stir for 10 min. Evaporate to dryness with air. Crystals melt at 60° C and begin to evaporate if decomposition temperature is not reached quickly. Material decomposed by U. V. light.

6. Bis-triethylphosphone palladium dichloride$[(C_2H_4)_3P]_2PdCl_2$ decomp. temp. 150° C. Slowly pour solution of 2 moles of triethylphosphine in alcohol, pluc 5% excess, into slurry of anhydrous palladium dichloride in acetone with stirring. Evaporate to dryness. Avoid contact with water; this complex forms highly unstable hydrates.

7. Bis-triethylphosphine palladium dimethyl$[(C_2H_5)_3P]_2Pd(CH_3)_2$ decomposition temperature of the material is very low; in the crystalline state the material decomposes in air and light before decomposition temperature can be determined. Dissolve 1 mole of bis-triethylphosphine palladium chloride in ether. Add 2 moles, plus 5% excess of methyl lithium slowly and allow to stir for 10 min. Evaporate to dryness with nitrogen. Material decomposes in air and is extremely U. V. sensitive.

8. Bis-triphenylphosphine palladium disecondary butyl - $[(C_6H_3)_3P]_2Pd[(CH_3)CHC_2H_5]_2$ decomp. temp. 270° C. Place 1 mole of bis-triphenylphosphine palladium dichloride in an ether slurry. Add 2 moles of secondary butyl lithium plus a 5% excess and allow to stir for 1 hour. Remove crystals by filtration. Wash with water and then with ether and dry in air.

9. Bis-triphenylphosphine palladium oxalate$[(C_6H_5)_3P]_2PdC_2O_4$ decomp. temp. 293° C. Dissolve 1 mole of bis-triphenylphosphine palladium dichloride in acetone. Slurry 1 mole plus 5% excess of sodium oxalate in water. Pour phosphine solution into oxalate slurry and allow to stir for 10 min. Filter crystals and dry.

10. Bis-triethylphosphine palladium oxalate$[(C_2H_5)_3P]_2PdC_2O_4$ decomp. temp. 275° C. Dissolve 1 mole of bis-triethylphosphine palladium dichloride in alcohol. Slurry 1 mole plus 5% excess of sodium oxalate in acetone. Pour the phosphine solution into the oxalate slurry and allow to stir for 10 minutes. Crystals are obtained by evaporating solvents.

11. Palladium acetylacetonate - $Pd(C_5H_7O_2)_2$ decomp. temp. 240° C. Place 1 mole of palladium dichloride in water solution with a slight excess of chloride ion as from HCl. Place 2 moles plus a 5% excess of sodium acetylacetonate in water solution. Mix the two solutions slowly with stirring and allow to stir for 20 min. Filter the crystals and wash with water.

12. Bis-triphenylphosphine palladium borohydride[$(C_6H_5)_3P]_2Pd(BH_4)_2$. Stability of complex is about the same as for complex given in Example 7. Place 1 mole of bistriphenylphosphine palladium dichloride in an acetone slurry. Dissolve 2 moles of sodium borohydride, plus 5% excess, in a high molecular weight alcohol. Slowly pour the borohydride solution into the chilled phosphine slurry with stirring. After 5 minutes of stirring evaporate to dryness with nitrogen gas. Store in dark freezer.

13. Bis-trimethylphosphite palladium dichloride[$(CH_3O)_3P]_2PdCl_2$ decomp. temp. 210° C. Place 1 mole of palladium dichloride in acetone slurry. Add 2 moles of trimethyl phosphite dropwise with stirring, allow to stir for 2 hours. Evaporate to dryness and redissolve in warm tetrahydrafuran. After shaking warm solution in calcium chloride crystals filter through fine pore filter. Complex recrystallizes on cooling and may be filtered and washed with cold tetrahydrafuran.

14. Bis-benzonitrile palladium dichloride $(C_6H_5C{\equiv}N)_2PdCl_2$ decomp. temp. 85° C. Place 2 gm of palladium dichloride in 50 ml of benzonitrile and warm mixture to 100° C. After 30 min. of stirring at 100° C. the palladium dichloride will dissolve to give a red solution. After filtering, the still warm solution is poured into 300 ml of petroleum ether to precipitate out the crystals. Crystals are removed by filtration and washed with cold petroleum ether.

15. 1,3-Butadiene palladium dichloride - $C_4H_6PdCl_2$ decomp. temp. 95° C. Place 2 gm of bis-benzonitrile palladium dichloride in a benzene solution. Bubble 1,3-butadiene through solution till color becomes yellow. Continue bubbling till crystals no longer fall out. Filter crystals.

16. Bis-acetonitrile palladium dichloride$(CH_3C \equiv N)_2PdCl_2$ decomp. temp. 130° C. Place 2 gm of palladium dichloride in 20 ml of acetonitrile and warm till all palladium dichloride dissolves. Vacuum filter while still hot, then cool to precipitate crystals. Filter. 17. Bis-triethylenetetramine palladium oxalate$[H_2NCH_2(CH_2NHCH)_2CH_2NH_2]_2PdC_2O_4$.

Dissolve 1 mole of palladium dichloride in water. Dissolve 2 moles 5% excess of triethylene-tetramine in water. Mix the two solutions and stir for 30 min. Add 2 moles of silver nitrate aqueous solution and stir till all silver chloride precipitates. Filter silver chloride and add 1 mole of sodium oxalate to filtrate. Material must be kept in an aqueous environment. Upon drying, it is decomposed immediately by light making determination of decomposition temperature impossible.

In general, all complexes decomposing below 100° C when dissolved in a suitable solvent are useful to deposit the catalyst for the electroless metal on a substrate such as a polyolefin, polyamide, polyester, or polyvinyl chloride. The complexes decomposing above 100° C must be selected with respect to the dimensional stability (non distortion) of the substrate which is to be catalyzed for acceptance of the electroless metal. Thus, as an example complexes of the group decomposing below 200° C are suitable for polyesters, especially those decomposing below 155° C.

The solvent for the disclosed complexes should be chosen on the basis of the following specific criteria. It must be a solvent in which the palladium complex is highly soluble, it must wet and should slightly swell the substrate's surface, and it must have a sufficiently high vapor pressure that the solvent flashes off quickly and evenly. The preferred solvent for this purpose is one which readily wets and swells the surface of the polymer. The organic solvents available and which were used successfully include benzene, dimethylsulfoxide, dimethylacetamide, formamide, dimethyl formamide, acetone, methanol, carbon tetrachloride, chloroform, toluene, 1,1,1-trichloroethane, isopropyl alcohol, ethyl ether, methyl ethyl ketone, and mixtures of solvents such as 50% benzene-50% tetrahydrofuran, 90% isopropyl alcohol-10% tetrahydrofuran, and 80% benzene-20% methyl ethyl ketone or mixtures of the aforesaid.

The substrate with the thin film of thermally decomposable complex upon it is then exposed to a hot, and preferably humid, air environment in which the complex is thermally decomposed to the catalytic residue.

The concentration of the complex or one of the other complexes in a suitable solvent e.g. in the tetrahydrofuran solvent or xylene or any of the other enumerated solvents or mixtures thereof is from 6 gm/l to 25 gm/l and in a series of runs were of a metal concentration of 2.0 to 6.0 gm/l Pd. Preferably, a complex concentration of 12.0 gm/l to 18 gm/l or a metal concentration of 3.0 gm/l Pd to 12.0 gm/l represent a desired concentration.

Thereafter, the film, catalytic to electroless nickel, copper, gold or cobalt is exposed to a bath suitable for depositing electroless copper, cobalt, nickel or gold onto the catalytic film. The desired circuitry areas are then selectively masked and the exposed spaces between the circuitry areas are deactivated such as by slight back etching to assure that the electroless metal as well as the catalytic residue has no effect on the circuit performance, i. e., for etchable metals.

In the event later back etching of copper or nickel is desired such as after electroless copper deposition of a continuous film, or after electrolytic build up of circuitry areas, further gold or tin - lead or other inert alloy combinations or multimetallic materials are deposited on the pattern with specific areas masked with an appropriate composition as it is well known in the art. The pattern may be completed by appropriately removing the masking composition and back etching the electroless copper deposit with a suitable etchant which is selective to the metal e.g. copper, such as ammonium persulfate, and which will not attack the overlying metal.

Besides the decomposition temperature criterion of the complex, other criteria for choosing the most desirable palladium complex for the thermal-catalyzation of substrate surfaces include: a material which is readily soluble in the preferred solvent systems; a material chemically stable for manipulating during the catalyzing operation, and stable in solution at operating temperatures; and a thermal decomposition temperature which is optimum for bonding the palladium residue (or its equivalent) to the particular polymer substrate, i.e. polyester or polyolefin employed; thus the complex should not have a decomposition temperature of above the temperature as determined for the substrate and previously explained above. For example, the decomposition temperature for use on low-temperature substrates will typically be below 210° C, being illustratively about 150° C for Mylar and polypropylene and under 100° C for polyethylene.

Suitable electroless baths are identified herein below.

| | |
|---|---|
| Electroless Coppers: | |
| I. Copper Sulphate | 10 gm/l |
| Sodium Hydroxide | 10 gm/l |
| Formaldehyde (37–41% W/V*) | 10 ml/l |
| Sodium Potassium Tartrate | 50 gm/l |
| II. Cupric Oxide | 3.0 gm/l |
| Sodium Hypophosphite | 10 gm/l |
| Ammonium Chloride | 0.1 gm/l |
| III. Copper Sulphate | 13.8 gm/l |
| Sodium Potassium Tartrate | 69.2 gm/l |
| Sodium Hydroxide | 20 gm/l |
| Formaldehyde (36% W/V,* 12.5% $CH_3OH$) | 40 ml/l |
| 2-Mercaptobenzothiazole | 0.003% |
| *weight by volume | |
| Bath Temp: Ambient | |
| Electroless Nickel: | |
| I. Nickel Chloride | 80 gm/l |
| Sodium Citrate | 100 gm/l |
| Ammonium Chloride | 50 gm/l |
| Sodium Hypophosphite | 10 gm/l |
| Bath Temp: 180° F ± 20 | |
| II. Nickel Chloride Hexahydrate | 20 gm/l |
| Ethylene Diamine (98%) | 45 gm/l |
| Sodium Hydroxide | 40 gm/l |
| Sodium Borohydride | 0.67 gm/l |
| Bath Temp: 180° F | |
| Electroless Cobalt: | |
| I. Cobalt Chloride Hexahydrate | 30 gm/l |
| Sodium Citrate Pentahydrate | 35 gm/l |
| Ammonium Chloride | 50 gm/l |
| Sodium Hypophosphite, Monohydrate | 20 gm/l |
| Bath Temp: 180° F | |
| II. Cobalt Sulphate, Heptahydrate | 24 gm/l |
| Ammonium Sulphate | 40 gm/l |
| Sodium Hypophosphite | 20 gm/l |
| Sodium Citrate | 80 gm/l |
| Sodium Lauryl Sulphate | 0.1 gm/l |
| Bath Temp: 180° F | |

Other baths which were tried and worked were Shipley NL-63 (a nickel bath), Richardson-NIKLAD 759-A (nickel); Shipley XP7006 (nickel).

Representative electroless copper baths which were used are the following: Dynachem 240; Shipley 3280; McDermid 9055.

Some of the illustrated baths are well known in the art and reference may be had to U.S. Pat. No. 3,095,309 and 3,546,009 which disclose electroless copper deposition baths and to Brenner, "Metal Finishing" November 1954, pages 68 to 76, which disclose electroless nickel baths. Electroless gold baths are disclosed in U.S. Pats. 3,123,484; 3,214,292; and 3,300,328 the disclosure of which is incorporated by reference. Typically, the electroless metal baths useful herein comprise a source of the metal ions, a reducing agent for those ions, a complexing agent and a compound for pH adjustment.

The following Examples further illustrate the invention.

EXAMPLE I.

A solution of bis-benzonitrile palladium dichloride is made by dissolving in tetrahydrafuran at a concentration of 3 gm/l of the complex. A piece of polyethylene terephthalate such as Dupont Mylar, polyester film, is soaked for 1 min. in a sulphonic acid-phenol-sodium hydrozide solution at 80° C., water rinsed, neutralized in a 20% citric acid solution for 1 min., water rinsed, acetone rinsed and dried at 100° C. for 1 min. The treated film is then immersed in the palladium catalyst solution for 30 sec. As the polyester strip is steadily withdrawn from the catalyst solution, the tetrahydrafuran solvent flashes off leaving a monomolecular film of bis-benzonitrile palladium dichloride. The film is then baked in an air oven at 100° C for 1 min. to decompose the complex to an adherent film of catalytic residue. When the treated film is immersed in an electroless copper bath identified above as Electroless Copper I or in a commercial electroless copper such as Shipley 328 Q or Dynachem 240, etc., approximately 5 micro inches of copper will deposit evenly over the film surface in 2 min. The copper layer is then electrolytically built up 50–100 micro inches in a copper sulfate-sulfuric acid bath (further described herein). After washing and drying the metallized film is coated with a photoresist, printed with a circuitry pattern, developed and washed. The film is then put back into the electrolytic copper bath and the circuitry pattern selectively built up to ½ mil, over which is plated 50–100 micro inches of tin - lead or other solder alloy. After washing, the photoresist is solvent stripped and the exposed non-circuitry copper conductor base is removed with a selective etch such as ammonium persulfate. The final product is a printed, flexible circuit on an inexpensive base ready for termination by friction methods such as leaf or edge connectors or flat cable stitch contacts.

EXAMPLE II.

The procedure set forth in Example I is repeated but instead as in Example I 1,3-butadiene palladium dichloride is used as the catalyst complex.

EXAMPLE III.

The procedure set forth in Example I is repeated but instead as in Example I olefin substrate is used with a palladium complex having a decomposition temperature below 98° C. Additionally aromatic hydrocarbons such as xylene, toluene, or chlorobenzene or mixtures thereof are used.

EXAMPLE IV.

The procedure as set forth in Example I is used but the pretreating solution is trichloroacetic acid in isopropyl alcohol.

EXAMPLE V.

The procedure as set forth in Example I is repeated but nylon 66 (a polyamide) is used.

EXAMPLE VI.

The procedure as set forth in Example I is repeated but polyvinylchloride is used as the substrate material with isopropyl alcohol used as the solvent system for the catalyst.

EXAMPLE VII.

The procedure as set forth in Example I is repeated, but sulfonic acid-phenol-sodium hydroxide is used as a surface treatment solution on olefin.

EXAMPLE VIII.

The procedure set forth in Example I is repeated but nickel or gold is used as the circuitry material.

EXAMPLE IX.

The procedure set forth in Example I is used and an electroless metal bath of nickel, cobalt or gold is used and deposits of good quality are obtained.

EXAMPLE X.

The procedure is repeated as in Example I but nickel is used in the circuitry as defined in bath "Electroless Nickel I."

EXAMPLE XI.

The procedure is repeated as in Example I but the initial deposit of copper is then masked, the electroless copper deposit back-etched rather than building up the circuitry.

EXAMPLE XII.

The procedure is repeated as in Example I using any of the catalyst complexes mentioned at their respective decomposition temperatures below 150° C on a polyester.

EXAMPLE XIII.

The procedure is repeated as in Example I but using trichloroacetic acid in isopropyl alcohol as the pretreating solution.

EXAMPLE XIV.

The procedure is repeated as in Example I but using a polyamide such as DuPont Nylon 6 as the substrate material.

EXAMPLE XV.

The procedure is repeated as in Example I but using polyolefins such as polyethylene, polypropylene or copolymers of same using aromatic hydrocarbons such as xylene, toluene, or chlorobenzene as the solvent system for the catalyst.

EXAMPLE XVI.

The procedure is repeated as in Example I but using vinyls such as PVC as the substrate material with isopropyl alcohol as the solvent system for the catalyst.

EXAMPLE XVII.

The procedure is repeated as in Example I but using a Copper Electroless Bath No. I defined above.

EXAMPLE XVIII.

The procedure is repeated as in Example I but using nickel or gold as the circuitry material.

EXAMPLE XIX.

The procedure is repeated as in Example I but using chemical etch rather than additive circuitry techniques.

With respect to electrolytic deposits which are employed to build up the circuit patterns electrolytically, the following baths are suitable:

| | | |
|---|---|---|
| A. | Copper Sulfate | 28.0 oz./gal |
| | Sulfuric Acid | 7.0 oz./gal |
| | Room Temp. Bath | (15 to 25° C) |
| | ASF (Amperes per square foot) | about 10 |
| or: | | |
| B. | Copper Fluoroborate | 60 ox./gal |
| | Copper (as metal) | 16 oz./gal |
| | Temp. of Bath - 120° F | |
| or: | | |
| C. | Copper Cyanide | 2–3.5 oz./gal |
| | Sodium Cyanide | 3.7–5.9 oz./gal |
| | Free Sodium Cyanide | 1.5–2.0 oz./gal |
| | Sodium Hydroxide | 0–½ oz./gal |

"Metals Finishing Guidebook Directory", Metal and Plastic Publications, Inc., Westwood, New Jersey (published annually) provides sufficient description of various other electrolytic compositions suitable for flat and/or flexible circuitry uses (as well as electroless bath).

What is claimed is:

1. A method for the deposition of a copper, nickel cobalt, or gold as metal onto an inert substrate for said metal said substrate being selected from the group consisting of polyester, polyamides, polyvinylchloride, polyethylene, polypropylene, copolymers of either polyolefin, and poly (1a) olefins in the homologous series of the polyethylene and polypropylene, from an electroless bath containing said metal, said method comprising the steps of:

degreasing said substrate;

applying to said substrate a thin film of a thermally decomposable complex of palladium or platinum having the formulae LmPdXn, or LmPtXn wherein L is a ligand or an unsaturated organic group; Pd or Pt is palladium or platinum metal; X is a halide, an alkyl group or a bidentate ligand; and *m* is from 1 to 4 and n is from 0 to 3 exposing said substrate to which said complex has been applied to heat at a temperature of less than a temperature at which the substrate loses its dimensional stability, to effect decomposition of said complex and to create a residue on said substrate catalytic to a copper, nickel, cobalt or gold metal in an electroless bath solution; and depositing a copper, nickel, cobalt or gold metal from said electroless bath on said substrate in an area rendered catalytic by decomposition of said complex.

2. The process as defined in claim 1 wherein said substrate is selected from the group consisting of polyesters useful as dielectrics in electrical circuit applications, polyethylene, polypropylene, copolymers of either polyolefin, and poly ($\alpha$) olefins in the homologous series of the polyethylene and polypropylene.

3. The process as defined in claim 1 wherein said substrate is polyethylene terephthalate.

4. The process as defined in claim 1 wherein said substrate is selected from the group consisting of polyethylene terephthalate and polypropylene and is exposed with said complex to heat at a temperature of between about 50° C and about 150° C, said complex decomposing at or below said temperature.

5. The process as defined in claim 1 wherein said substrate is polyethylene and is exposed with said complex to heat at a temperature up to about 98° C, said complex decomposing at or below said temperature.

6. The process as defined in claim 1, wherein the palladium complex is selected from the group consisting of bis-benzonitrile palladium dichloride, 1,3-butadiene palladium dichloride, and bis-acetonitrile palladium dichloride.

7. The process as defined in claim 1, wherein the said substrate, after application of said complex decomposition of same and immersion in an electroless bath, is masked and additionally an electroless metal deposit is made and, thereafter the additional deposit protected, said mask removed and said substrate back-etched to obtain a circuit element.

8. The process as defined in claim 1 and wherein the substrate is a polyamide.

9. The process as defined in claim 1 and wherein the substrate is polyvinylchloride.

10. The process as defined in claim 2, wherein the said substrate, after application of said complex and electroless metal in a nickel, cobalt, copper or gold electroless bath solution, is masked and exposed to further additive electroless deposition.

11. The process as defined in claim 2 and wherein the substrate is degreased before applying said complex to same by a solvent which wets and slightly swells the surface of said substrate.

12. The process as defined in claim 7 wherein said substrate after said further additive deposition is stripped of said mask and back-etched in areas wherein said electroless metal has been deposited.

13. The process as defined in claim 3, wherein the palladium complex is selected from the group consisting of bis-benzonitrile palladium dichloride, 1,3-butadiene palladium dichloride, and bis-acetonitrile palladium dichloride.

14. The process as defined in claim 4, wherein the palladium complex is selected from the group consisting of bis-benzonitrile palladium dichloride, 1,3-butadiene palladium dichloride, and bis-acetonitrile palladium dichloride.

15. The process as defined in claim 5 wherein the palladium complex is chosen from the group consisting of bis-benzonitrile palladium dichloride, 1,3-butadiene palladium dichloride, and bis-acetonitrile palladium dichloride.

* * * * *